United States Patent [19]

Canup

[11] 3,996,911

[45] Dec. 14, 1976

[54] MEANS AND METHOD FOR CONTROLLING THE OCCURRENCE AND THE DURATION OF TIME INTERVALS DURING WHICH SPARKS ARE PROVIDED IN A MULTICYLINDER INTERNAL COMBUSTION ENGINE

[75] Inventor: Robert E. Canup, Chester, Va.

[73] Assignee: Texaco Inc., New York, N.Y.

[22] Filed: Dec. 19, 1974

[21] Appl. No.: 534,252

[52] U.S. Cl. ..... 123/148 E; 123/117 R

[51] Int. Cl.[2] ..... F02P 5/04; F02P 1/00

[58] Field of Search ... 123/32 EA, 117 R, 146.5 A, 123/148 E

[56] References Cited

UNITED STATES PATENTS

| | | | |
|---|---|---|---|
| 3,454,871 | 7/1969 | Nolting | 123/117 R |
| 3,738,339 | 6/1973 | Huntzinger et al. | 123/117 R |
| 3,749,073 | 7/1973 | Asplund | 123/117 R |
| 3,752,139 | 8/1973 | Asplund | 123/117 R |
| 3,757,755 | 9/1973 | Carner | 123/117 R |
| 3,808,513 | 4/1974 | Canup | 123/148 E |
| 3,831,563 | 8/1974 | Brittain et al. | 123/32 EA |
| 3,853,103 | 12/1974 | Wahl et al. | 123/117 R |
| 3,855,973 | 12/1974 | Scofield | 123/146.5 A |
| 3,908,616 | 9/1975 | Sasayama | 123/117 R |

*Primary Examiner*—Charles J. Myhre
*Assistant Examiner*—Ronald B. Cox
*Attorney, Agent, or Firm*—T. H. Whaley; C. G. Ries; Ronald G. Gillespie

[57] ABSTRACT

A control system controls the occurrence and the duration of time intervals during which sparks may be provided in the cylinders of an internal combustion engine driving a crankshaft as a function of operating parameters of the engine. Sensors sense parameters such as the vacuum in the carburetor, the position of the throttle and the torque of the crankshaft and provide corresponding signals. A distributor provides a pulse signal. Each pulse in the pulse signal has a width corresponding to a predetermined rotational displacement of the crankshaft. A counter with associated logic circuitry counts clock pulses in an up-direction during the occurrence of a pulse of the distributor pulse signal. When the counter counts down to a particular count, a decoder triggers a one shot multivibrator to provide a pulse, each pulse provided by the one shot multivibrator corresponds to the start of a spark time interval. A preset circuit receives the sensed parameter signals and presets the decoder so as to select the particular count to control the time of occurrence of the spark time intervals. A second counter is loaded with clock pulses at a reduced rate, simultaneously with the loading of the first counter. During the unloading of the first counter, the second counter is inactive. However the second counter is then unloaded at a faster rate when the spark time interval is started. Upon reaching a zero count, a spark time interval is terminated. An ignition system provides sparks to cylinders during each spark time interval.

15 Claims, 2 Drawing Figures

MEANS AND METHOD FOR CONTROLLING THE OCCURRENCE AND THE DURATION OF TIME INTERVALS DURING WHICH SPARKS ARE PROVIDED IN A MULTICYLINDER INTERNAL COMBUSTION ENGINE

BACKGROUND OF THE INVENTION

1. Field of the Invention

The present invention relates to control systems in general and, more particularly, to a control system for controlling the occurrence and the duration of spark time intervals during which sparks are provided to various cylinders in an internal combustion engine.

SUMMARY OF THE INVENTION

A system controls the occurrence and the duration of time intervals during which sparks are provided in a multicylinder combustion engine for driving a crankshaft. The system includes a distributor providing a pulse signal in which each pulse has a width corresponding to a predetermined rotational displacement of the crankshaft. Sensors sense different operating parameters of the engine and crankshaft and provide corresponding signals. A pulse network provides a start pulse in accordance with timing pulses from a timing pulse source, with the sensed parameter signals, and with the pulse signals from the distributor. A circuit provides an end signal at the end of each spark time interval in accordance with the timing pulses and the pulses from the distributor. Apparatus responsive to the start pulses and the end signals provide sparks to the cylinders in a predetermined manner in accordance with the start pulses and the end signals so as to control the occurrence and the duration of the spark time intervals during which sparks are provided to the cylinders.

The objects and advantages of the invention will appear more fully hereinafter from a consideration of the detailed description which follows, taken together with the accompanying drawings wherein one embodiment of the invention is illustrated by way of example. It is to be expressly understood, however, that the drawings are for illustration purposes only and are not to be construed as defining the limits of the invention.

DESCRIPTION OF THE INVENTION

A spark advance in an internal combustion engine which is spark ignited is required because there is a finite time lag between the time the spark is initiated and the plug gap is ionized, and a finite time from the instant the air fuel mixture is ignited until the pressure in the cylinder has increased to the desired amount. An empirical rule (Upton's rule) states that approximately three-fourths the time of combustion and one half the pressure rise should have occurred at top dead center of the piston.

The spark rise time and the burning time of the fuel is essentially constant at all engine speeds. Therefore, the spark must be initiated earlier before top dead center and earlier in terms of crankshaft degrees as the engine speed is increased. For example, if the total time from spark initiation until the pressure build reaches one half of its maximum volume is 2,000 microseconds then the spark should be initiated six crankshaft degrees before top dead center at 500 engine rpm. However, at 5,000 engine rpm, the spark should be initiated at 60 crankshaft degrees before top dead center. Regardless of engine speed, the spark must be initiated at the 2,000 microsecond point before top dead center. Thus time as a function of operating parameters is the controlling factor.

Figure 1:
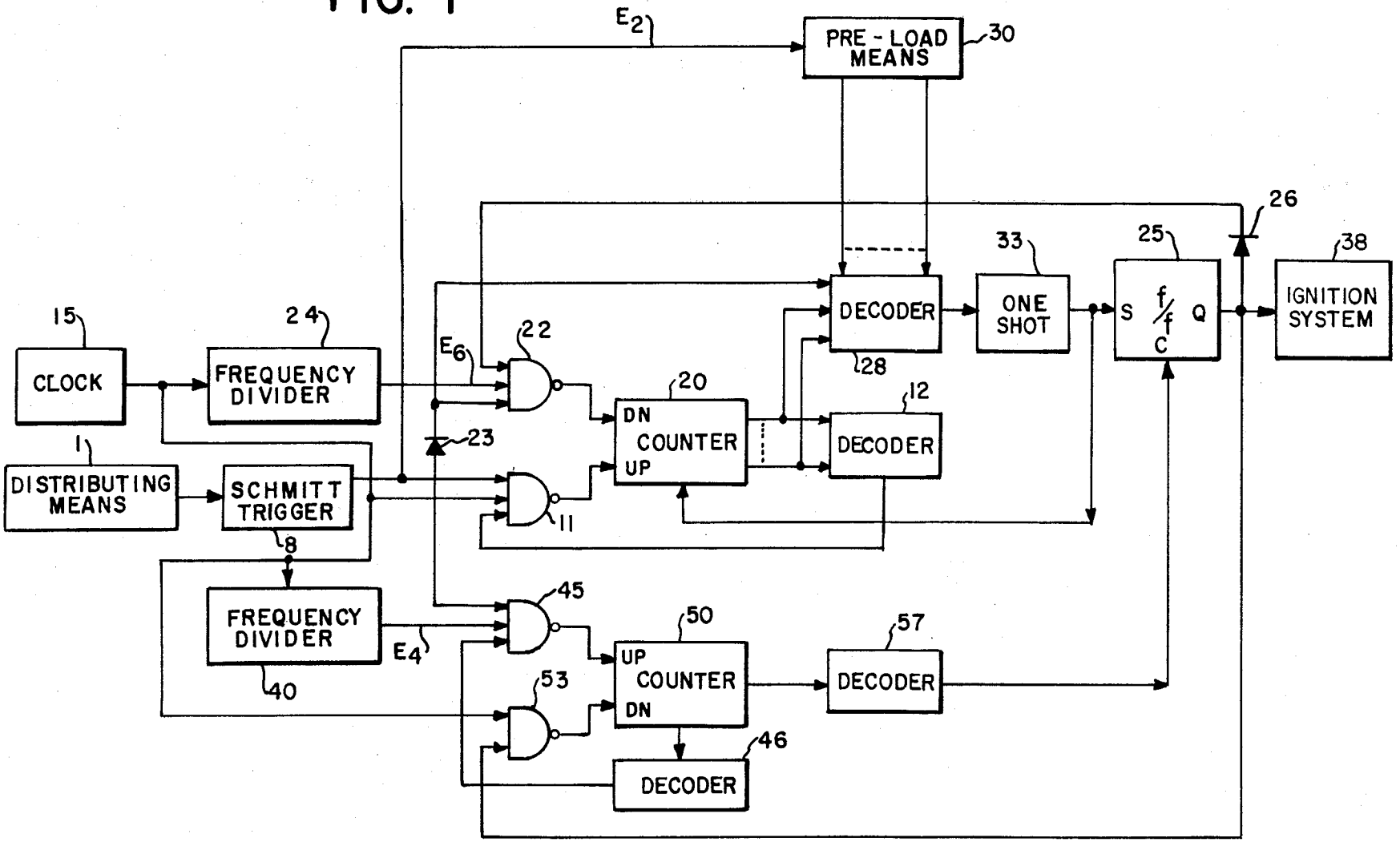
FIG. 1 is a simplified block diagram of a control system constructed in accordance with the present invention, for controlling the occurrence and the duration of time intervals during which sparks are provided in an internal combustion engine.

Referring to FIG. 1, distributing means 1 provides rectangular pulses $E_1$. The width of pulses $E_1$ is fixed and corresponds to a predetermined number of angular degrees of a crankshaft (not shown) and is set to occur immediately after top dead center of each piston. There are numerous ways to provide pulses $E_1$; the details are not necessary to an understanding of the present invention. One way may be through the use of an optical shutter driven by an internal combustion engine (not shown), which also drives the crank shaft, in a manner so that a predetermined number of pulse $E_1$ occurs every two revolutions of the crankshaft. The number of pulses $E_1$ occurring every two revolutions of the crankshaft corresponds to the number of cylinders in the engine. The engine has a carburetor (not shown) and a throttle (not shown). Each pulse $E_1$ causes a Schmitt trigger 8 to provide a corresponding rectangular pulse $E_2$ whose width is also related to the predetermined number of crankshaft degrees. Pulse $E_2$ enables a NAND gate 11 along with a high level output from a decoder 12. NAND gate 11 passes clock pulses $E_3$ from a clock 15 to an up input of a counter 20 to be counted up. Counter 20 continues to count the passed $E_3$ clock pulses from NAND gate 11 until pulse $E_2$ from Schmitt trigger 8 is terminated thereby disabling NAND gate 11. Should by some chance counter 20 reach a maximum count, decoder 12 decodes the maximum count to provide a low level output to NAND gate 11 thereby disabling it to stop further counting by counter 20 in the up direction.

The count in counter 20 corresponds in time to the rate at which the crankshaft is turning, thus as the crankshaft is turning slowly, counter 20 contains a large count. When the engine is operated at a higher speed, counter 20 contains a lesser count since it takes a corresponding shorter period of time for the crankshaft to rotate a fixed number of degrees.

The output from Schmitt trigger 8 is connected to another NAND gate 22 through an inverter 23. A frequency divider 24 provides pulse $E_6$ at a reduced rate to NAND gate 22 in response to clock pulses $E_3$ from clock 15. It is not necessary to provide pulses $E_6$ at a reduced rate but it is preferred for reasons hereinafter stated. When Schmitt trigger 8 provides a pulse $E_2$, NAND gate 22 is disabled by the inverted pulse from inverter 23 and blocks clock pulses $E_3$ from clock 15. NAND gate 22 also received the Q output from a flip flop 25 provided through another inverter 26. When flip flop 25 is in a clear state, the $\overline{Q}$ output is at a high level and the Q output is at a low level. When flip flop 25 is in the set state, the Q and $\overline{Q}$ outputs are at a high level and a low level, respectively. When pulse $E_2$ from Schmitt trigger 8 is terminated, inverter 23 provides a high level input to NAND gate 22. NAND gate 22 is now fully enabled and passes clock pulses $E_3$ to the down input of counter 20. Counter 20 starts to count down. A decoder 28 decoding the count in counter 20 provides an output when counter 20 reaches a count that is determined by preset means 30. Decoder 28 does not provide an output when counter 20 is counting up, since the inverted pulse from inverter 23 also inhibits decoder 28.

The output from decoder 28 triggers a one-shot multivibrator 33 which in turn provides a pulse which resets counter 20 to zero and set flip flop 25. With flip flop 25 being in a set state, the Q output from inverter 26 goes to a low level disabling NAND gate 22 to prevent further counting by counter 20. The Q output from flip flop 25 is also provided to an ignition system 38 which may be of a type disclosed and described in U.S. Pat. No. 3,792,695 (issued Feb. 19, 1974). The Q output from flip flop 25 being at a high level allows ignition system 38 to provide sparks to a cylinder in the engine.

The timing relationship between pulses $E_1$ to top dead centers for the pistons is adjusted so that when counter 20 reaches a zero count it coincides with top dead center for a cylinder. Since the decoder is preset to a count greater than zero, the cylinders will fire at the time prior to top dead center corresponding to the difference between the preset count and the zero count. The time will remain constant regardless of crankshaft rotational speed as long as the engine's operating parameters remain constant. The time before firing will vary as a function of the engine's operating parameters.

Whether counter 20 is unloaded at the same rate or at a lesser rate then the loading of counter 20, is determined by the number of cylinders in the engine. For example, a four cylinder engine may be loaded and unloaded at the same rate. A four cyliner engine has a 180° between firings. Since we are loading and unloading at the same rate, we have one half of 180°, or 90°, available for spark advance.

However, for an 8-cylinder engine, there is 90° between firings which only have 45° available for spark advance. However, it has been determined that at high speeds, a spark advance of greater than 70° may be required. By loading at a rate four times faster than unloading, the dynamic range of crankshaft degrees is increased for spark advance. Thus for the 8-cylinder engine, the maximum spark advance is four-fifths of the degrees between firing or 72°.

It should be noted that the portion of the invention hereinbefore described may be used with conventional type ignition systems, where only one spark is provided to each cylinder during each cycle, to control the advance or retardation of the spark. The following section of the system concerns those ignition systems providing multiple sparks to each cylinder during each cycle.

Timing pulses $E_3$ are applied to a frequency divider 40 which in effect divides the pulse repetition rate of pulses $E_3$ by three to provide pulses $E_4$. Pulses $E_4$ are provided to a NAND gate 45 which also receives pulse $E_2$ from Schmitt trigger 8 and a high level voltage from a decoder 46. NAND gate 45 when enabled by pulse $E_2$ passes timing pulses $E_4$ to an up input of a counter 50. Thus, counter 50 is counting pulses $E_4$ while counter 20 is counting pulses $E_3$, but since the repetition rate of pulses $E_4$ is at one-third of the repetition rate of pulses $E_3$ the count in counter 50 will be one-third of the count in counter 20. Decoder 46 is an overload decoder. In the event the count in counter 50 reaches a maximum count decoder 46 provides a low level output of NAND gate 45 to disable it thus preventing further counting of pulses $E_4$ by counter 50 in an up direction.

Timing pulses $E_3$ are provided to another NAND gate 53 receiving the Q output from flip flop 25, thus counter 50 counts for the same time span as counter 20 counts up so that its output corresponds to one-third of the count in counter 20 is counting down counter 50 is not doing anything. As hereinbefore explained, flip flop 25 is triggered to a set state when counter 20 reaches a count determined by decoder 28. The Q output of flip flop 25 goes to a high level enabling NAND gate 53 to pass timing pulses $E_3$ to a down input of counter 50 so that counter 50 is now being down counted at a rate three times greater than its up count rate. Upon reaching a count of zero, a decoder 57 provides a pulse output to clear flip flop 25 causing the Q output to go to a low level thereby terminating the spark time interval.

As can be seen, the count in counter 50 controls the time duration of the spark time interval as a function of angular degrees. No matter how fast the engine is turning over, the spark time interval bears a constant relationship in angular degrees to the crankshaft.

Figure 2:
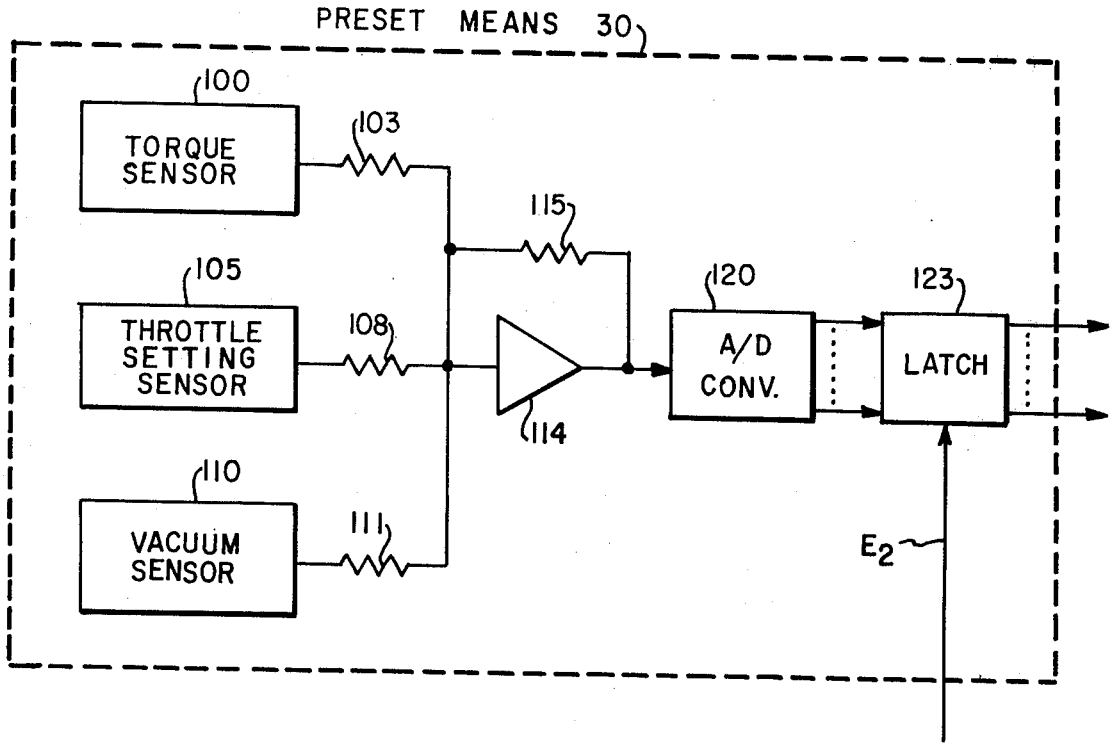
FIG. 2 is a detailed block diagram of the present means shown in FIG. 1.

Referring to FIGS. 1 and 2, preset means 30 includes a torque sensor 100, measuring the torque in the crankshaft, provides a signal corresponding to the measured torque to a resistor 103. A sensor 105 senses the throttle position and provides a corresponding signal to another resistor 108. A vacuum sensor 110 senses the vacuum in the carburetor and provides a corresponding signal to a resistor 111. Resistors 103, 108 and 111 are connected to the input of an amplifier 114, having a feedback resistor 115 connecting its input to its output. Resistors 103, 108 111 and 115, in cooperation with amplifier 114, form a summing network. The output from amplifier 114 is converted to digital signals and provided to a latch 123 receiving pulses $E_2$. As the sensed parameters change the digital signals provided by converter 120 also change. However, latch 123 only enters the signals from converter 120 in response to a pulse $E_2$. Latch 123 provides digital signals to decoder 28. Since latch 123 only enters signals in response to a pulse $E_2$, the digital signals provided by latch 123 remains constant until the next pulse $E_2$ even though the sensed parameters may change.

The system and method of the present invention, as heretofore described, controls the occurrence and duration of spark time intervals during which sparks are provided to cylinders in a multicylinder internal combustion engine. The system and method provides for controlling spark time intervals so that sparks are provided in the cylinders for a predetermined amount of crankshaft degrees of rotation regardless of the crankshaft speed. The system and method of the present invention controls the occurrence of the spark time intervals as a function of the operating parameters of the engine and crankshaft.

What is claimed is:

1. A system for controlling the occurrence and duration of time intervals during which sparks are provided in a multicylinder internal combustion engine for driving a crankshaft and each cylinder has a movable piston, comprising distributor means for providing a pulse signal, each pulse in the pulse signal having a width corresponding to a predetermined rotational displacement of a crankshaft, means for providing clock pulses, sensing means for sensing different operating parameters of an engine and of the crankshaft and providing corresponding signals, means connected to the distributor means, to the timing pulse means and to the sensing means for providing a start signal in accordance with the sensed parameter signals, with the clock pulses, and with the pulse signal from the distributor means, means connected to the distributor means and to the timing pulse means for providing an end signal in accordance with the clock pulses and the pulse signal from the distributor means, and means connected to the start signal means and to the end signal means for providing sparks to cylinders in a predetermined manner in accordance with the start and the end signals so as to control the occurrence and the duration of the spark time intervals during which sparks are provided to the cylinders.

2. A system as described in claim 1 in which the number of pulses in each cycle of the pulse signal corresponds to the number of cylinders in the engine, and the occurrence of a pulse in each cycle of the pulse signal has a predetermined relationship to the position of a piston in a corresponding cylinder.

3. A system as described in claim 2 in which each cycle of the second pulse signal corresponds to two revolutions of the crankshaft.

4. A system described in claim 3 in which the start signal means includes a first bi-directional counting means having an up-input and a down-input which counts pulses applied to the up-input in one direction and counts pulses applied to the down-input in another direction, means for providing clock pulses, first switching means connected to the distributor means, to the up-input of the counter and to the clock pulse means for passing the clock pulses from the clock pulse means to the up-input of the counter when a pulse in the second pulse signal occurs, and for blocking the clock pulses from the clock pulse means when a pulse in the second pulse signal does not occur, second switching means connected to the clock pulse means and to the distributor means and receiving a spark time interval signal for blocking the clock pulses when a pulse in the pulse signal occurs or the spark time interval signal is at a first amplitude and for passing the clock pulses when a pulse in the pulse signal does not occur and the spark time interval signal is at a second amplitude, frequency dividing means connected to the second switching means and to the down-input of the counter for providing pulses having a lower pulse repetition rate to the down-input of the counter in response to the clock pulses passed by the second switching means, programmable means connected to the counter for providing a start pulse as the start signal when the counter contains a count substantially the same as a programmed count, and means connected to the sensing means, to the programmable means and to the distributor means for programming a count into the programmable means in accordance with the first pulse signal and the second parameters signals, and the spark means includes means connected to the programmable means, the second switching means and to the end signal means for providing the spark time interval signal to the second switching means at the second amplitude in response to a start pulse and at the first amplitude in response to the end signal, and ignition means connected to spark time interval means for providing sparks to the cylinders in the predetermined manner when the spark time interval signal is at the second amplitude and for not providing any spark to any cylinder when the spark time interval is at the first amplitude.

5. A system as described in claim 4 in which the start pulse is applied to the counter to reset the counter to a predetermined count.

6. A system for controlling the occurrence and duration of time intervals during which sparks are provided in a multicylinder internal combustion engine for driving a crankshaft and each cylinder has a movable piston, comprising distributor means for providing a pulse signal, each pulse in the pulse signal having a width corresponding to a predetermined rotational displacement of a crankshaft; means for providing clock pulses; sensing means for sensing different operating parameters of an engine and of the crankshaft and providing corresponding signals; means connected to the distributor means, to the timing pulse means and to the sensing means for providing a start signal in accordance with the sensed parameter signals, with the clock pulses, and with the pulse signal from the distributor means; and signal means connected to the distributor means and to the timing pulse means for providing an end signal in accordance with the clock pulses and the pulse signal from the distributor means, said end signal means includes a second bi-directional counter having an up-input and a down-input and counting pulses applied to the up-input in one direction and counting pulses applied to a down-input in another direction, second frequency dividing means connected to the clock pulse means for providing clock pulses at a pulse repetition rate less than that of the clock pulses from the clock pulse means, third switching means connected to the distributor means, to the second frequency dividing means and to the up-input of the second counter for passing the clock pulses from the second frequency dividing means to the up-input of the second counter when a pulse in the second pulse signal occurs and for blocking the counting pulses from the second frequency dividing means when a pulse in the second pulse signal does not occur, fourth switching means connected to the clock pulse source, to the spark time interval signal means and to the down-input of the second counter for passing the clock pulses from the clock pulse means to the down-input of the second counter when the spark time interval signal at the second amplitude and for blocking the clock pulses from the clock pulse means when the spark time interval signal is at the first amplitude, and decoding means connected to the second counter and to the spark time interval signal means for providing the end signal when the second counter reaches a predetermined count while counting in the other direction after counting in the one direction and not providing the end signal while the second counter is counting; and means connected to the start signal means and to the end signal means for providing sparks to cylinders in a predetermined manner in accordance with the start and and end signals so as to control the occurrence and the duration of the spark time intervals during which sparks are provided to the cylinders.

7. A system as described in claim 6 in which the spark time interval signal means is a flip flop having a set input and a clear input, the set input being connected to the programmable means and the clear input being connected to decoding means, which is triggered from a clear state to a set state when a start pulse is applied to the set input and is triggered from a set state to a clear state by leading edge of the end signal when it occurs, and the flip flop provides the spark time interval signal at the first amplitude when in the clear state and at the second amplitude when in the set state.

8. A system as described in claim 7 in which the engine has a carburator and throttle, and the sensed parameters are the vacuum in the carburator, the position of the throttle and the torque of the crankshaft.

9. A method for controlling the occurrence and the duration of time intervals during which sparks are provided in a multicylinder internal combustion engine for driving a crankshaft, each cylinder having a movable piston, comprising the steps of:

providing a pulse signal, each pulse in the pulse signal having a width corresponding to a predetermined rotational displacement of the crankshaft, providing a clock pulses, reducing the frequency of the clock pulses to provide reduced frequency clock pulses, sensing different operating parameters of the engine and the crankshaft, providing signals corresponding to the sensing parameters, providing a start signal in accordance with the sensed parameter signals, the clock pulses, the reduced frequency clock pulses and the pulse signal, reducing the frequency of the clock pulses to provide second reduced frequency clock pulses, providing an end signal in accordance with the clock pulses, the second reduced frequency clock pulses and the pulse signal, and providing sparks to cylinders in a predetermined manner in accordance with the start and the end signals so as to control the occurrence and the duration of the spark time intervals during which sparks are provided to the cylinders.

10. A method as described in claim 9 in which the numbers of pulses in each cycle of the pulse signal corresponds to the number of cylinders in the engine, and the occurrence of a pulse in each cycle of the pulse signal has a predetermined relationship to the position of the piston in a corresponding cylinder.

11. A method as described in claim 10 in which each cycle of the pulse signal corresponds to two revolutions of the crankshaft.

12. A method as described in claim 11 in which the start signal step includes counting the clock pulses in one direction when a pulse in the second pulse signal occurs, counting the reduced frequency clock pulses in an opposite direction when a pulse in the second pulse signal does not occur and a spark time interval signal's amplitude is at a low amplitude, not counting the clock pulses when a pulse in the second pulse signal does not occur and the amplitude of the spark time interval signal is at a high level, providing a start pulse as the start signal when the count substantially corresponds to a programmed count, and providing a progammed count in accordance with the first pulse signal and the second parameter signals; and the step of providing the sparks includes providing the spark time interval signal at the high amplitude in response to a start pulse and at the low amplitude in response to the end signal, providing sparks to the cylinders in a predetermined manner when the spark time interval signal has a high amplitude, and not providing a spark to any cylinder when the spark time interval signal has a low amplitude.

13. A method as described in claim 12 in which the count is returned to zero upon the occurrence of a start pulse.

14. A method for controlling the occurrence and the duration of time intervals during which sparks are provided in a multicylinder internal combustion engine for driving a crankshaft, each cylinder having a movable piston, comprising the steps of:

providing a pulse signal, each pulse in the pulse signal having a width corresponding to a predetermined rotational displacement of a crankshaft;

providing clock pulses;

reducing the frequency of the clock pulses to provide reduced frequency clock pulses;

sensing different operating parameters of an engine and the crankshaft;

providing signals corresponding to the sensing parameters;

providing a start signal in accordance with the sensed parameter signals, the clock pulses, the reduced frequency clock pulses and the pulse signal;

reducing the frequency of the clock pulses to provide second reduced frequency clock pulses;

providing an end signal in accordance with the clock pulses, the second reduced frequency clock pulses and the pulse signal;

the end signal step includes counting the second reduced frequency clock pulses in one direction when a pulse in the pulse signal occurs, not counting the second reduced frequency clock pulses in the one direction when a pulse in the pulse signal does not occur, counting the clock pulses in another direction to reduce the count from the last mentioned counting step when the spark time interval signal is at the high amplitude, not counting the clock pulses when the spark time interval signal is at the low amplitude, decoding the count from the last mentioned counting step when a predetermined count is reached to provide the end signal, and not providing the end signal while the last two mentioned counting steps are going on; and providing sparks to cylinders in a predetermined manner in accordance with the start and the end signals so as to control the occurrence and the duration of the spark time intervals during which sparks are provided to the cylinders.

15. A method as described in claim 14 in which the engine has a carburator and a throttle, and the sensed parameters are the vacuum in the carburator, the position of the throttle and the torque of the crankshaft.

* * * * *